US009121196B2

(12) United States Patent
McDaid et al.

(10) Patent No.: US 9,121,196 B2
(45) Date of Patent: Sep. 1, 2015

(54) DIGITAL OUTPUT LOCK

(76) Inventors: Cornelius McDaid, Randolph, MA (US); Robert D. Zuraski, Taunton, MA (US); John Paul Thambusami Joy Sachidanadam, Stoughton, MA (US)

( * ) Notice: Subject to any disclaimer, the term of this patent is extended or adjusted under 35 U.S.C. 154(b) by 743 days.

(21) Appl. No.: 12/478,285

(22) Filed: Jun. 4, 2009
(Under 37 CFR 1.47)

(65) Prior Publication Data

US 2011/0016931 A1 Jan. 27, 2011

Related U.S. Application Data

(63) Continuation of application No. 12/254,467, filed on Oct. 20, 2008, now abandoned.

(60) Provisional application No. 60/981,235, filed on Oct. 19, 2007.

(51) Int. Cl.
*E05B 37/10* (2006.01)

(52) U.S. Cl.
CPC ..... *E05B 37/10* (2013.01); *Y10T 70/424* (2015.04); *Y10T 70/7051* (2015.04); *Y10T 70/7418* (2015.04)

(58) Field of Classification Search
CPC ..... E05B 37/00; E05B 37/02; E05B 37/08; E05B 37/10; E05B 47/00; E05B 67/22; E05B 49/00; E05B 49/004; E05B 49/006; E05B 49/008; E05B 37/025; Y10T 70/7418; Y10T 70/424; Y10T 70/7051
USPC ..... 70/301, 302, 303 R, 303 A, 445, 446, 70/24–26, 330–332, 333 R, 333 A, 70/432–437, 278.4, 278.5, 278.6, 278.7, 70/279.1, 277, 278.1, 282, 366; 340/5.55
See application file for complete search history.

(56) References Cited

U.S. PATENT DOCUMENTS

| | | | | | |
|---|---|---|---|---|---|
| 1,349,321 | A | * | 8/1920 | Carter, Jr. | 40/495 |
| 1,652,897 | A | * | 12/1927 | Hill | 70/333 A |
| 3,197,752 | A | * | 7/1965 | Rabinow | 340/870.02 |
| 3,835,680 | A | * | 9/1974 | Evans | 70/278.4 |
| 3,901,057 | A | * | 8/1975 | Coley, Sr. | 70/20 |
| 3,952,559 | A | | 4/1976 | Atkinson | |
| 4,262,284 | A | | 4/1981 | Stieff et al. | |
| 4,631,940 | A | * | 12/1986 | Krivec et al. | 73/332 |
| 4,766,419 | A | | 8/1988 | Hayward | |
| 5,493,279 | A | * | 2/1996 | Dawson et al. | 340/5.32 |
| 5,604,489 | A | * | 2/1997 | Hyatt, Jr. | 340/5.55 |
| 5,873,276 | A | * | 2/1999 | Dawson et al. | 70/277 |
| 5,914,669 | A | * | 6/1999 | Wicks et al. | 340/7.21 |
| 5,982,168 | A | * | 11/1999 | Westberg et al. | 324/160 |
| 6,029,482 | A | | 2/2000 | Rifkin | |
| 6,081,199 | A | * | 6/2000 | Hogl | 340/5.28 |

(Continued)

*Primary Examiner* — Lloyd Gall
(74) *Attorney, Agent, or Firm* — RatnerPrestia

(57) ABSTRACT

A lock assembly comprising a lock body, a shackle, and a locking member configured to selectively lock the shackle relative to the lock body. At least one combination dial is rotatable between various combination positions. The at least one combination dial is associated with the locking member and is configured such that entry of a given series of combination positions causes the locking member to unlock the shackle relative to the lock body. A sensor is configured to sense the rotational position of the al least one combination dial. A display screen is associated with the sensor and is configured to display a position indicia which corresponds to the rotational position of the at least one combination dial.

23 Claims, 9 Drawing Sheets

(56) References Cited

U.S. PATENT DOCUMENTS

| | | | | |
|---|---|---|---|---|
| 6,345,898 | B1 * | 2/2002 | Roach | 362/23 |
| 6,442,983 | B1 * | 9/2002 | Thomas et al. | 70/38 A |
| 7,236,085 | B1 * | 6/2007 | Aronson et al. | 340/5.64 |
| 7,932,810 | B2 * | 4/2011 | Gartner | 340/5.2 |
| 7,934,405 | B2 * | 5/2011 | Burmesch et al. | 70/25 |
| 2006/0267728 | A1 | 11/2006 | Kamrath | |
| 2007/0056339 | A1 * | 3/2007 | Irgens et al. | 70/312 |
| 2007/0131007 | A1 * | 6/2007 | Hacker | 70/433 |

* cited by examiner

DIGITAL OUTPUT LOCK

BACKGROUND OF THE INVENTION

The present invention relates in general to locks, and more particularly to combination locks, and most particularly to combination locks having a digital readout.

Heretofore, many types of combination lock mechanisms have been devised, wherein rotation of a dial or dial knob assembly through a selected combination of turns to different predetermined angular positions conditions a locking mechanism within the lock casing or body to release a locking shoulder or the like from the shackle member or other lock member. This permits the shackle member or other lock member to be shifted to a release position relative to the lock casing or body.

SUMMARY OF THE INVENTION

The present invention provides a lock assembly comprising a lock body, a shackle, and a locking member configured to selectively lock the shackle relative to the lock body. At least one combination dial is rotatable between various combination positions. The at least one combination dial is associated with the locking member and is configured such that entry of a given series of combination positions causes the locking member to unlock the shackle relative to the lock body. A sensor is configured to sense the rotational position of the at least one combination dial. A display screen is associated with the sensor and is configured to display a position indicia which corresponds to the rotational position of the at least one combination dial.

DETAILED DESCRIPTION OF THE INVENTION

Figure 1:
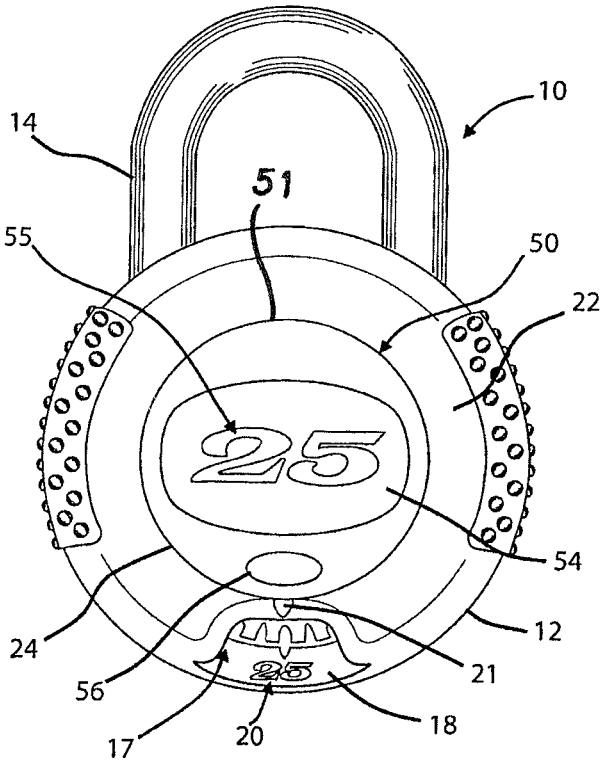
FIG. 1 is a front plan view of a padlock in accordance with an exemplary embodiment of the invention.
Figure 2:
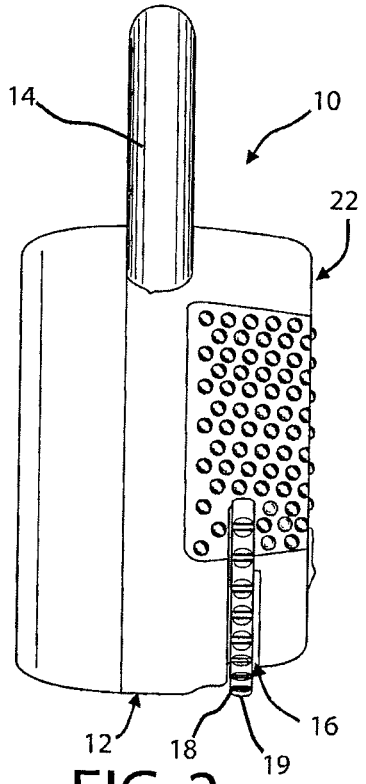
FIG. 2 is a side elevation view of the padlock of FIG. 1.
Figure 3:
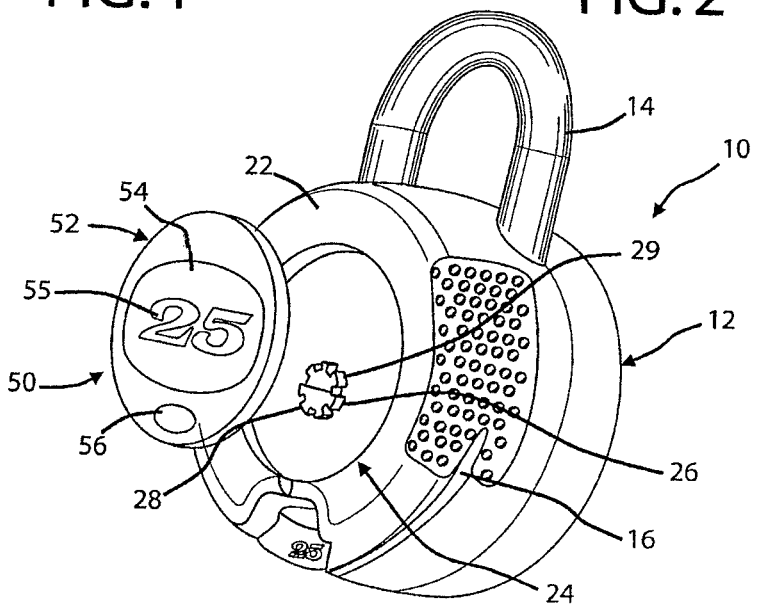
FIG. 3 is a perspective view of the padlock of FIG. 1 partially exploded.

Although the invention is illustrated and described herein with reference to specific embodiments, the invention is not intended to be limited to the details shown. Rather, various modifications may be made in the details within the scope and range of equivalents of the claims and without departing from the invention.

Referring to FIGS. 1-5, a lock assembly 10 in accordance with an exemplary embodiment of the invention is shown. In the present embodiment, the lock assembly 10 is in the form of a padlock, with a u-shaped shackle 14 lockably moveable relative to a lock body or casing 12. A combination dial 18 extends from the casing 12 and is rotatable relative thereto. In the present embodiment, the dial 18 is generally supported internally within the casing 12, with only a contact portion 19 extending radially outward through a slot 16 in the casing 12. A notch 17 is provided in the front face 22 of the casing 12 to allow a user to see the combination indicia 20 on the face of the dial 18. A corresponding indicator 21 is provided on the front face 22 adjacent to the notch 17. Alignment of the dial indicia 20 with the indicator 21 provides a first indication of the position of the dial 18 relative to the casing 12.

In the present embodiment, the front face 22 of the casing 12 has a recess 24 configured to receive a digital display assembly 50. The digital display assembly 50 includes a housing 52 configured to be retained within the recess 24. In a desired embodiment, the housing 52 is releaseably retained in the recess 24, for example, via a snap fit, such that the digital display assembly 50 may be removed to change a battery or the like. Other mechanisms for releaseably retaining the digital display assembly 50 may also be utilized, for example, a thread between the housing 50 and the recess 24 or a mechanical fastener extending through the housing 50 and engaged with the casing 12. Alternatively, the digital display assembly 50 may be permanently secured in the recess 24. In such an embodiment, the battery access may be provided through the face of the digital display assembly 50 or via some other means.

The digital display assembly 50 includes a digital display screen 54 configured to display a digital indicia 55 which represents a second indication of the position of the dial 18 relative to the casing 12. The digital display screen 54 can have various forms, for example, but not limited to, a light-emitting diode (LED); a vacuum fluorescent display (VFD) or a liquid crystal display (LCD). A light switch 56 or the like may be provided on the digital display assembly 50 to allow a user to provide additional illumination to the digital display screen 54.

The digital indicia 55 will correspond to the dial indicia 20 that is aligned with the casing indicator 21. As such, the user will be able to monitor the position of the dial 18 via either the dial indicia 20 or the digital indicia 55. To correlate the dial indicia 20 with the digital indicia 55, an engagement member 28 extends from the front face of the dial 18 through an opening 26 in the casing 12. The opening 26 is preferably within the recess 24 such that the engagement member 28 may engage the digital display assembly 50 and remain concealed when the digital display assembly 50 is positioned within the recess 24.

Figure 4:
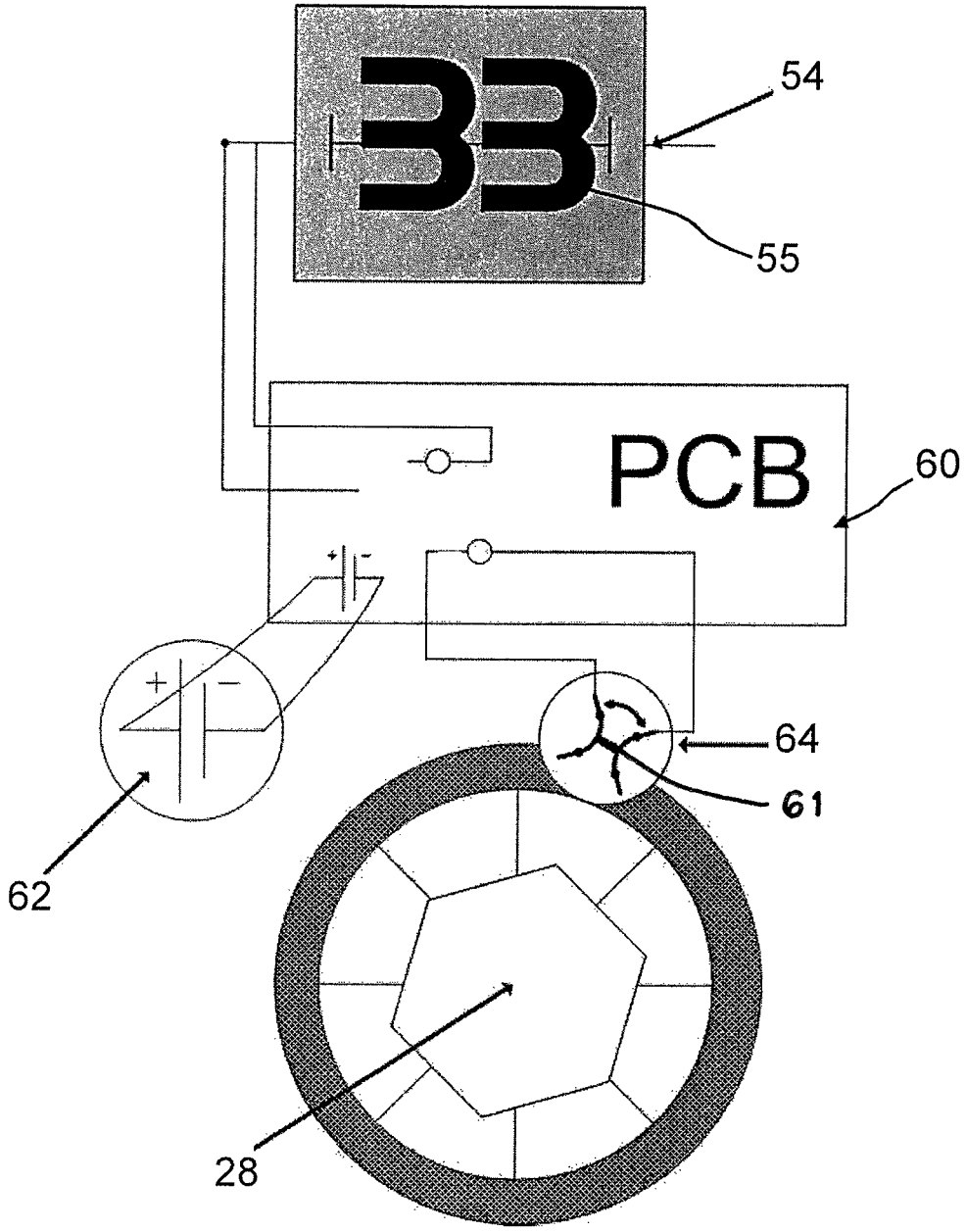
FIG. 4 is a schematic illustration of the digital display assembly of the padlock of FIG. 1.

Referring to FIG. 4, the digital display assembly 50 includes a microcontroller 60, for example, in the form of a printed circuit board or the like. A bi-directional location sensor 64 is associated with the microcontroller 60 and is configured for engagement with the engagement member 28 extending from the dial 18. In the illustrated embodiment, the engagement member 28 includes a plurality of teeth 29 configured to engage corresponding teeth (not shown) on the sensor 64 such that rotation of the dial 18 in either direction causes corresponding rotation of a portion of the sensor 64 which in turn provides an electrical signal to the microcontroller corresponding to such rotation. Alternatively, the sensor 64 may not require mechanical engagement with the engagement member 28, but may instead electronically monitor the position of the engagement member 28. For example, the engagement member 28 and sensor 64 may include corresponding magnets and a hall-effect sensor to monitor the rotational position of the dial 18. Other engagement configurations between the engagement member 28 and the sensor 64 may also be utilized.

The digital display assembly 50 preferably includes a mechanism 51 to synchronize the microcontroller 60 with the position of the dial 18. For example, the digital display assembly 50 may include a reset button (not shown) which is pressed when the dial 18 is at a predetermined indicia 20 (for example, at the zero position), thereby synchronizing the microcontroller 60 to the dial 18 position. Alternatively, the sensor 64 may include a contact switch 61 which is actuated when the digital display assembly 50 is positioned in the recess 24. Upon actuation of the switch, the microcontroller 60 is reset to a given indicia. A user would be instructed to set the dial 18 to the given indicia prior to installation of the digital display assembly 50, thereby synchronizing the microcontroller 60 to the dial 18 position. Other means for synchronizing the microcontroller 60 with the dial 18 may also be utilized.

With the microcontroller 60 synchronized with the dial 18 position, the microcontroller 60 is configured to receive signals from the sensor 64 which correspond to a given change in dial position in either direction. The microcontroller 60 continuously relates the position change with the previously stored position of the dial 18 and continuously determines the current position of the dial 18. The microcontroller 60 converts the current position to the appropriate digital indicia 55 which is displayed on the display screen 54. The microcontroller 60 is preferably powered by a replaceable battery 62 or the like.

The digital display assembly 50 may be further configured to include a speaker or the like (not shown) to provide audible indicia. The microcontroller 60 sends a signal to the speaker corresponding to the current position of the dial 18 and the speaker converts the signal received from the microcontroller 60 and outputs an audible indicia corresponding to the current position of the dial 18.

Figure 5:
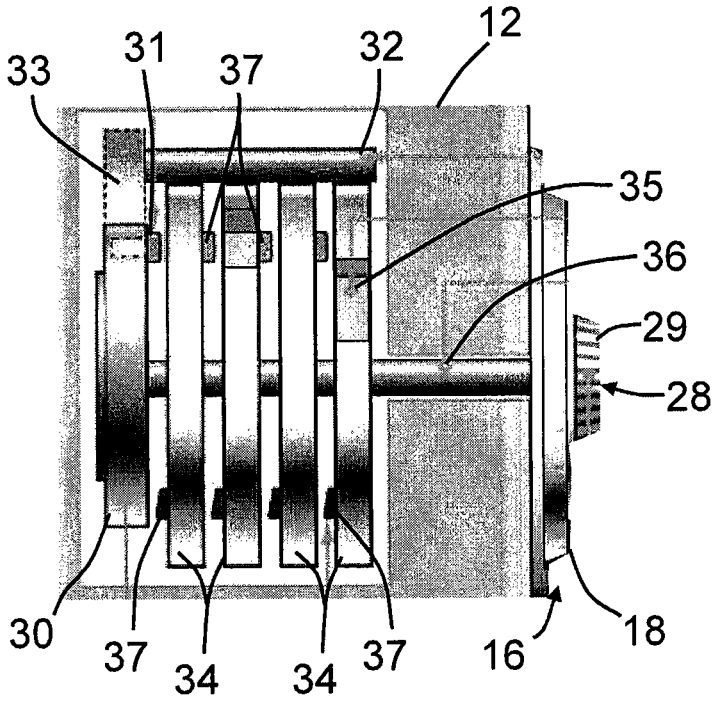
FIG. 5 is an illustration of the internal locking assembly of the padlock of FIG. 1.
Figure 6:
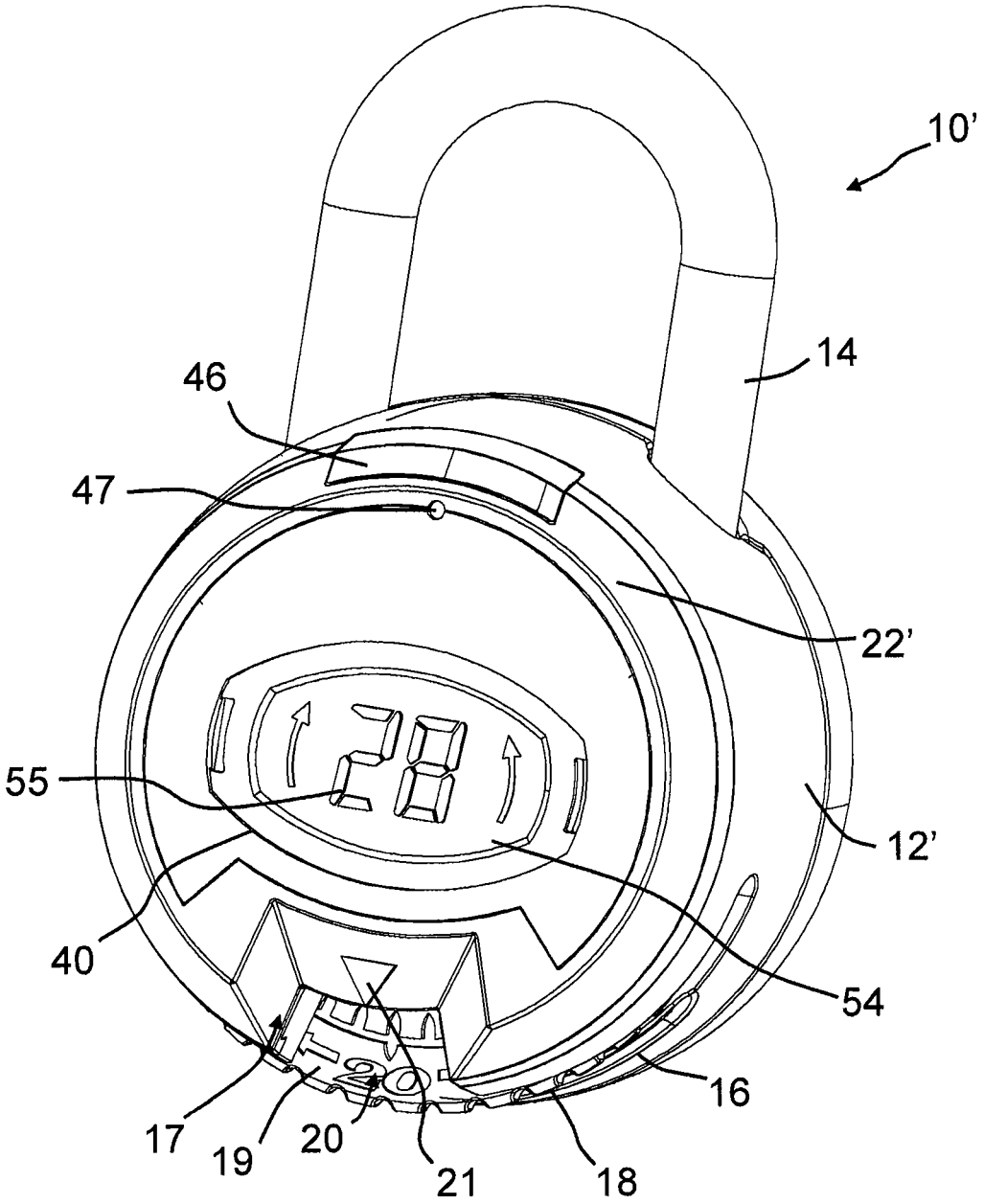
FIG. 6 is a perspective view of a padlock that is an alternative exemplary embodiment of the invention.

Referring to FIG. 5, the lock assembly 10 of the present embodiment is a padlock with a locking member that includes a drive cam 30, a hasp 32 and a series of notched wheels 34 mounted on a spindle 36 connected to the dial 18. While the present embodiment shows four wheels 34, any number of wheels 34 may be utilized. When the dial 18 is turned, the spindle 36 turns the drive cam 30. Attached to the drive cam 30 is a drive pin 31. As the cam 30 turns, the drive pin 31 eventually makes contact with a small tab on the adjacent wheel 34 called the wheel fly 37.

Each wheel 34 has a wheel fly 37 on each of its sides. The drive pin 31 spins the first wheel fly 37 until it makes contact with the wheel fly 37 of the wheel 34 adjacent to it. This continues until all the wheels 34 are spinning. Each wheel 34 on the spindle 36 has a notch 35 cut into it. When the right combination is dialed, as indicated by either the dial indicia 20 or the digital indicia 55, all the wheels 34 and their notches 35 line up perfectly. The hasp 32 is a small metal bar attached to a lever 33. The hasp 32 engages the shackle 14 and prevents the lock assembly 10 from being opened without the combination being dialed. In the present invention, a user of the lock assembly 10 may monitor the combination being dialed using either the dial indicia 20 or the digital indicia 55.

Figure 7:
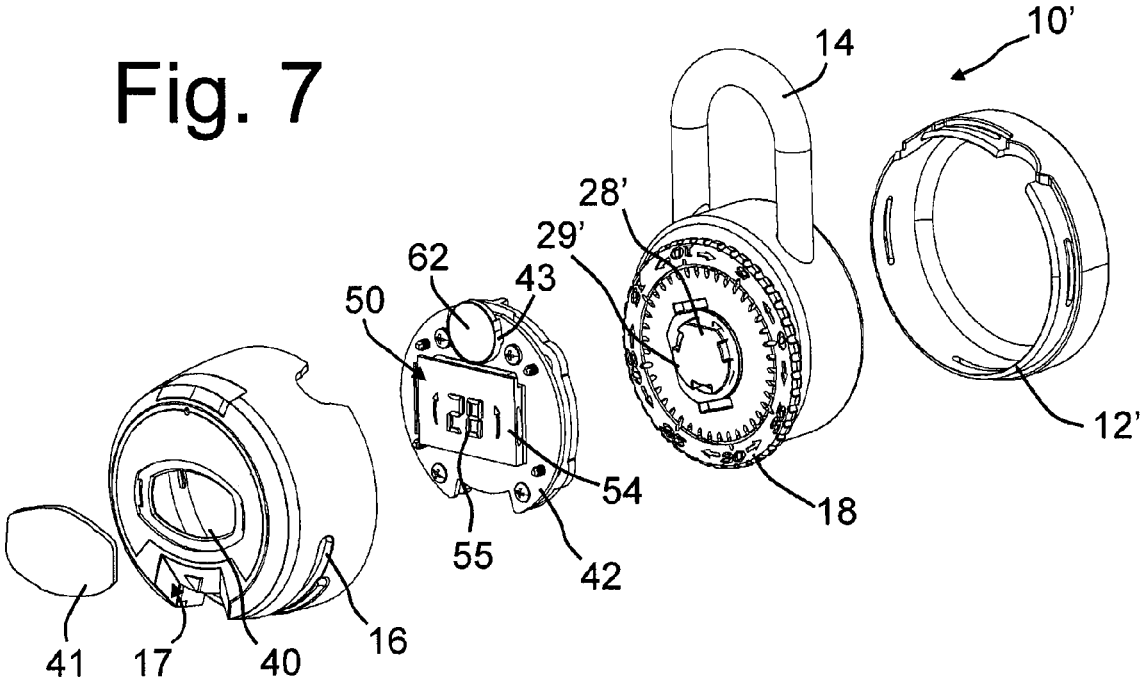
FIG. 7 is an exploded, front perspective view of the padlock of FIG. 6.

Referring to FIGS. 6-12, a lock assembly 10' in accordance with another exemplary embodiment of the invention is shown. The lock assembly 10' is substantially the same as in the previous embodiment with only the differences described herein. In the present embodiment, the front face 22' of the casing 12' includes a display opening 40 configured to align with the digital display assembly 50. As shown in FIG. 7, a cover 41 or the like is configured to fit in the opening 40 to protect the digital display screen 54.

Figure 8:
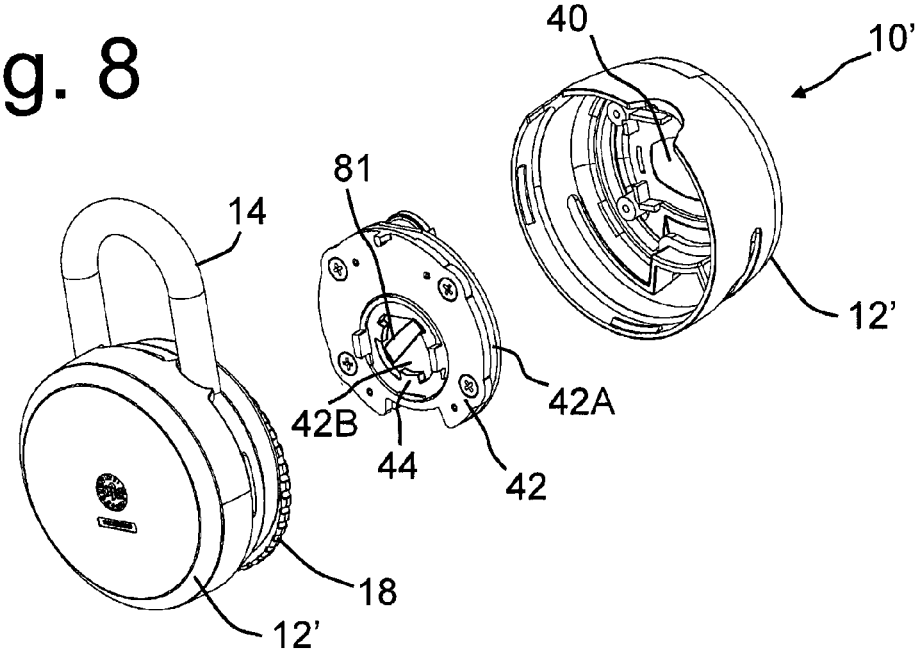
FIG. 8 is an exploded, rear perspective view of the padlock of FIG. 6.

Referring to FIGS. 7 and 8, the digital display assembly 50 is configured to be supported on a digital display platform 42 which is supported within the casing 12'. The digital display platform 42 may further include a battery contact 43 configured to electronically engage the battery 62, however, the battery 62 and associated contacts 43 may be otherwise positioned within the casing 12'. The platform 42 also supports the microcontroller engagement teeth 44 which are configured to engage the teeth 29' of the engagement member 28' extending from the dial 18. As shown, the teeth 29' and 44 may configured to have a single engagement orientation such that the sensor 64 is synchronized with the dial 18 upon interconnection.

Figure 9:
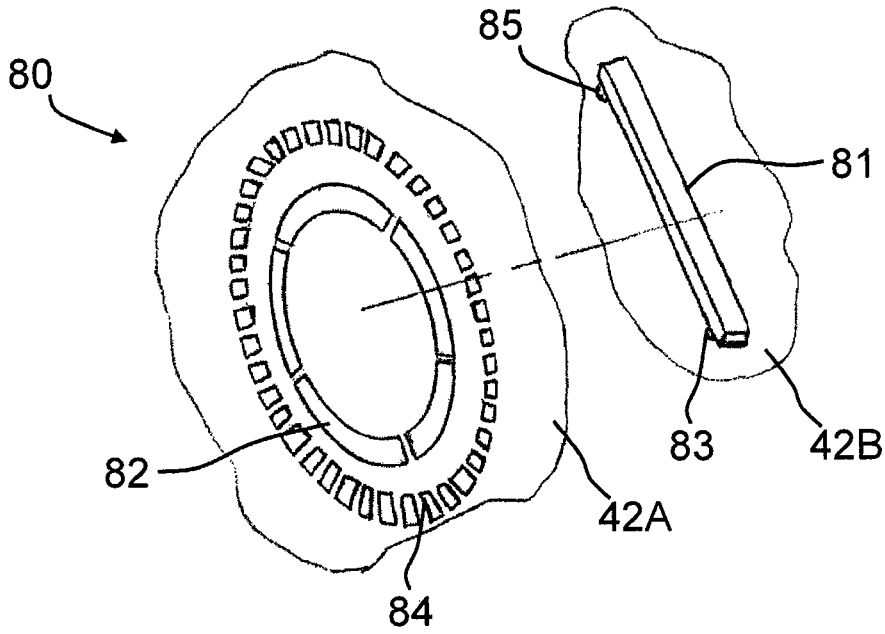
FIG. 9 is an exploded, perspective view of a contact assembly of the padlock of FIG. 6.
Figure 10:
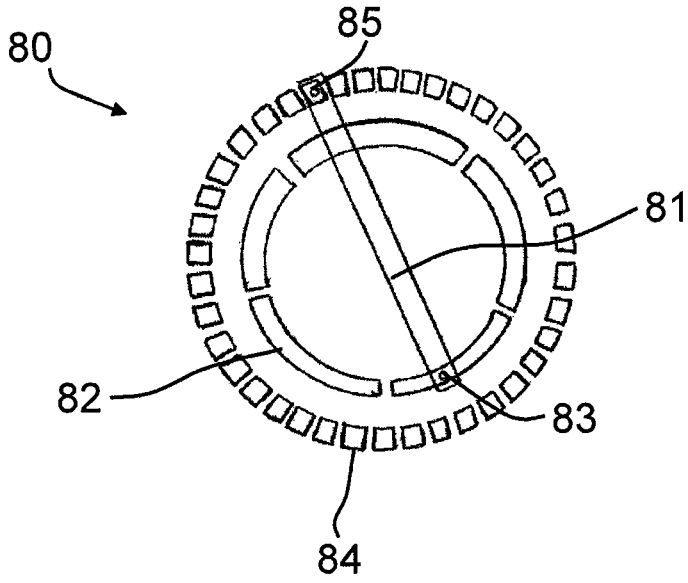
FIG. 10 is a plan view of the contact assembly of FIG. 9.

Referring to FIGS. 9 and 10, the digital display platform 42 may further support a contact assembly 80 to sense the position of the dial 18. In this embodiment, the contact assembly 80 forms a part of the sensor 64. The contact assembly 80 includes an inner set of radial contacts 82 and an outer set of radial contacts 84 supported on a first portion 42A of the platform 42. Each contact 84 of the outer set preferably corresponds to a position of the combination dial 18. While one or more inner contacts 82 may be used, multiple inner contacts 82 are preferred to assist with synchronization of the components. A contact bar 81 having a pair of spaced contacts 83 and 85 is configured to be mounted on a second portion 42B of the platform 42 such that the contact bar 81 rotates with the combination dial 18. As shown in FIG. 10, one of the contacts 83 is aligned with the inner contacts 82 and the other contact 85 is aligned with the outer contacts 84.

As the dial 18 is rotated, the contacts 83 and 85 will move between inner and outer contacts 82, 84, respectively. Each combination of inner contact 82 and outer contact 84 that the contact bar 81 is in contact with will have a distinct resistance or capacitance value. As such, by determining the resistance value or capacitance value occurring at any given time, the sensor 64 may determine the current position of the dial 18 and provide such to the digital display assembly 50. In other regards, the lock assembly 10' operates substantially the same as the lock assembly 10 described above.

Figure 11:
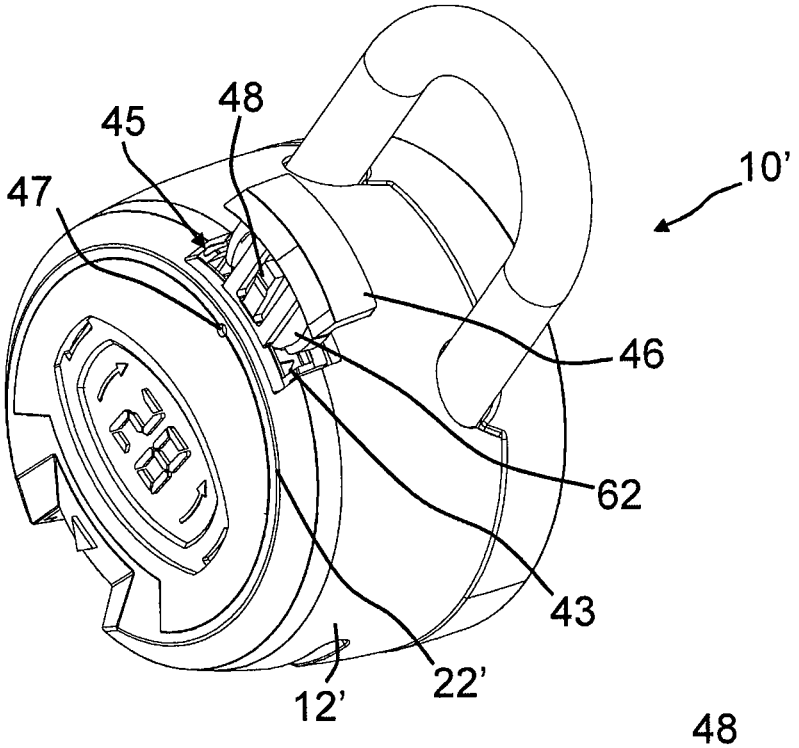
FIG. 11 is a perspective view of the padlock of FIG. 6 with the battery partially removed.
Figure 12:
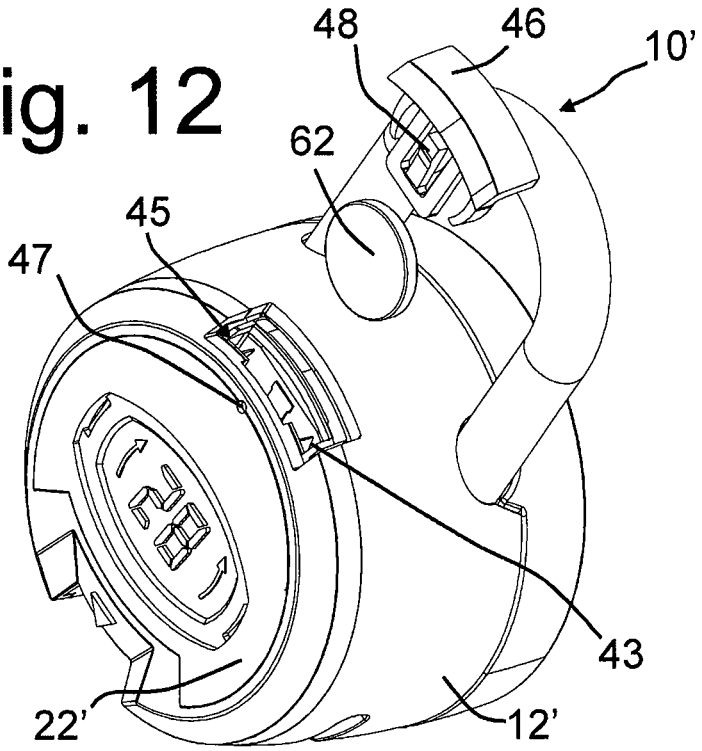
FIG. 12 is a perspective view of the padlock of FIG. 6 with the battery fully removed.

Referring to FIGS. 11 and 12, replacement of the battery 62 will be described. The battery 62 is supported on a battery tray 46 configured to be positioned in a battery compartment 45 defined within the casing 12'. The battery tray 46 is configured to align with and engage the battery 62 with the battery contact 43 within the casing 12'. The battery tray 46 includes a locking prong 48 biased toward a locking position. When the battery tray 46 is fully inserted into the battery compartment 45, the locking prong 48 engages a shoulder (not shown) within the battery compartment 45 which prevents withdrawal of the battery tray 46. A through hole 47 extends through the front face 22' of the casing 12' and is aligned with a portion of the locking prong 48 when such is in the locked position. To remove the battery 62, a pin or the like (not shown) is inserted through the through hole 47 such that the locking prong 48 is pushed from engagement with the shoulder. With the locking prong 48 disengaged, the battery tray 46 may be removed from the battery compartment 45. The other embodiments described herein may include a similar battery compartment and battery tray or may include different battery configurations.

Figure 13:
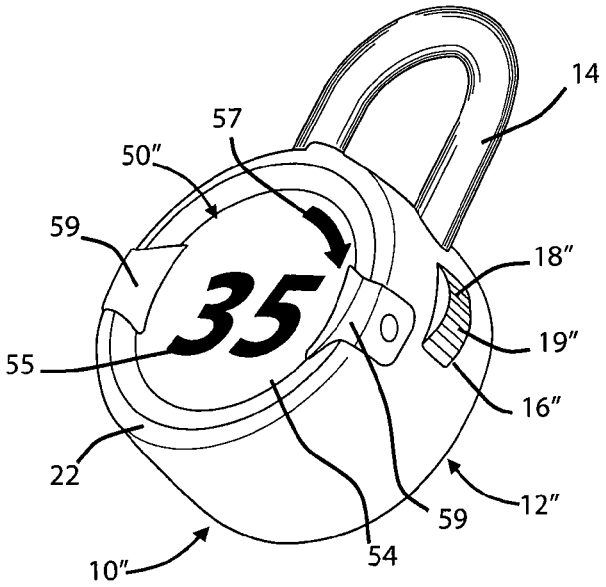
FIG. 13 is a perspective view of a padlock that is another alternative exemplary embodiment of the invention.
Figure 14:
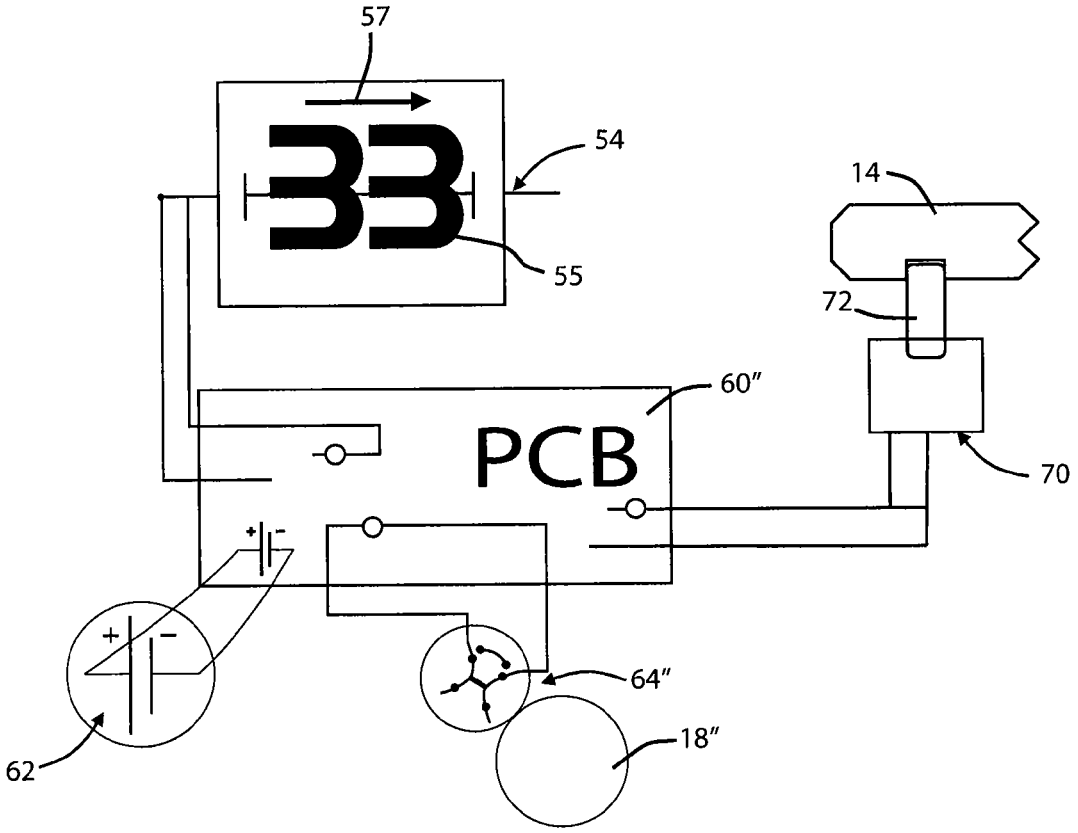
FIG. 14 is a schematic illustration of the digital display and control assembly of the padlock of FIG. 13.

Referring to FIGS. 13 and 14, a lock assembly 10" that is another exemplary embodiment of the invention will be described. In the present embodiment, the lock assembly 10" is again in the form of a padlock, with a u-shaped shackle 14 lockably moveable relative to a lock body or casing 12". A combination dial 18' extends from the casing 12" and is rotatable relative thereto. In the present embodiment, the dial 18" is generally supported internally within the casing 12", with only a contact portion 19" extending radially outward through an opening 16" in the casing 12". In the illustrated embodiment, the dial 18" is positioned along the side of the casing for easy thumb rotation, but other configurations may also be utilized. The dial 18" of the present embodiment does not include any indicia thereon. Instead, the indicia 55 and 57 are provided via a digital display assembly 50" attached to a front face 22 of the casing 12". In the present embodiment, clamps 59 are secured to the casing 12" and retain the digital display assembly 50" in position. As in the previous embodiment, the digital display assembly 50" includes a display screen 54 configured to display the indicia 55 and 57.

In the present embodiment, locking and unlocking of the lock assembly 10" is electronically controlled via the microcontroller 60". A locking solenoid 70 is associated with the microcontroller 60" and includes a normally extended retractable locking bolt 72. The locking bolt 72 is configured to engage a notch or the like in the shackle 14. The locking solenoid 70 has a non-energized condition in which the locking bolt 72 is extended into the locked position such that the lock assembly 10" will remain locked even if the microcontroller 60" loses power.

The microcontroller 60" is configured to actuate the locking solenoid 70 and retract the locking bolt 72 upon entry of a target combination through the dial 18". The target combination is preferably stored in non-volatile memory such that the target combination is retained for the life of the lock assembly 10", even if the microcontroller 60" loses power. The target combination is preferably a series of numbers, letters, icons or the like in conjunction with corresponding directional rotation of the dial 18". For example, the target combination could be two turns to the right to the number 35, one turn to the left to number 12, and one turn to the right to number 27. Various combinations of numbers, letters, icons, and directions may be utilized.

Entry of combination elements is through the combination dial 18" which engages a bi-directional position sensor 64". The bi-directional position sensor 64" is substantially the same as in the previous embodiment and may be a mechanical sensor, an electrical sensor or a combination thereof. The position and direction of rotation of the dial 18" are sensed by the sensor 64" and conveyed to the microcontroller 60". Synchronization is not required in the present embodiment. Upon power up, the microcontroller 60" may select and display any start position value, for example, a zero position value. The user would then have to enter the target combination by rotating the dial 18" as necessary from the start position value.

The microcontroller 60" is configured to receive signals from the sensor 64" which correspond to a given change in dial position in either direction. The microcontroller 60" continuously relates the position change with the previously stored position of the dial 18" and continuously determines the current position of the dial 18". The microcontroller 60" converts the current position to the appropriate digital indicia 55 which is displayed on the display screen 54. The microcontroller 60" may further be configured to display a directional indicia 57 on the display screen 54. Such directional indicia 57 would help the user viewing the display screen 54 to know that the dial 18" is being rotated in the correct direction. Once the target combination is entered through the dial 18", the microcontroller 60" actuates the locking solenoid 70 and the locking bolt 72 is retracted such that the shackle 14 is released and the lock assembly 10" is opened.

Figure 15:
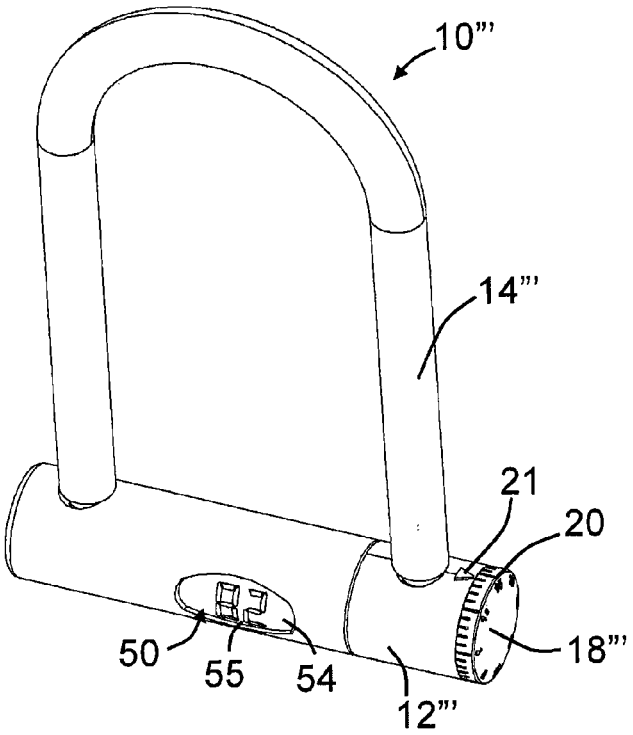
FIG. 15 is a perspective view of a U-lock that is another alternative exemplary embodiment of the invention.
Figure 16:
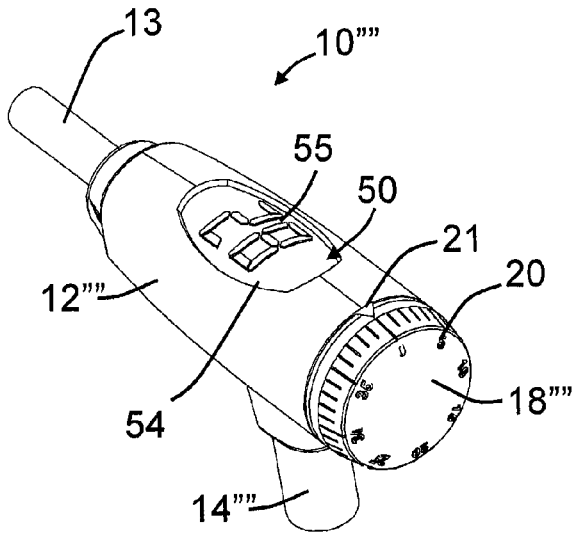
FIG. 16 is a perspective view of a portion of a cable lock that is an alternative exemplary embodiment of the invention.

FIGS. 15 and 16 illustrate additional alternative lock assemblies 10''' and 10'''' in accordance with the present invention. The lock assembly 10''' illustrated in FIG. 15 is in the form of a U-lock and includes a shackle 14''' engaged with a lock body or crossbar 12'''. The crossbar 12''' includes a combination dial 18''' configured to manipulate a locking member within the crossbar 12''', either mechanically, electrically or a combination thereof. The crossbar 12''' further includes a digital display assembly 50 with a display screen 54 configured to display a digital indicia 55 corresponding to the position of the dial 18''' relative to the crossbar 12'''. In other aspects, the lock assembly 10''' is substantially as described above.

The lock assembly 10'''' illustrated in FIG. 16 is in the form of a cable lock and includes a cable 13 extending from a lock body or casing 12''''. An opposite end of the cable 13 includes a locking head 14'''' configured to be inserted into the casing 12'''' and engaged by a locking member therein such that the cable 13 and locking head 14'''' define the shackle for the present embodiment. The casing 12'''' includes a combination dial 18'''' configured to manipulate the locking member within the crossbar 12'''', either mechanically, electrically or a combination thereof. The casing 12'''' further includes a digital display assembly 50 with a display screen 54 configured to display a digital indicia 55 corresponding to the position of the dial 18'''' relative to the crossbar 12''''. In other aspects, the lock assembly 10'''' is substantially as described above.

While the exemplary embodiments are described herein with a notched wheel and cam driver locking member or a locking solenoid locking member, the invention is not limited to such. Various other locking members, for example, tumbler locking members, latch and bolt locking members and the like may be utilized. Additionally, while only a single combination dial is illustrated in each exemplary embodiment, more than one combination dial may be utilized. In embodiments utilizing more than one combination dial, a separate display screen may be provided for each dial or single display screen may be configured to display multiple indicia, with each indicia corresponding to a respective dial. Additionally, while the exemplary embodiments described herein are portable lock assemblies, the invention is not limited to such. The present invention may be embodied in a stationary combination lock, for example, a built in combination lock on a locker. In such an embodiment, the locking member may extend between to portions of the stationary structure. The digital display assembly may be provided on the lock structure or the stationary structure.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A lock assembly comprising:

a lock body;

a shackle;

a locking member configured to selectively lock the shackle relative to the lock body;

at least one combination dial rotatable between various combination positions, the at least one combination dial associated with the locking member and configured such that entry of a given series of combination positions causes the locking member to unlock the shackle relative to the lock body;

a sensor configured to sense the rotational position of the at least one combination dial, wherein the sensor includes a contact assembly comprising (i) a contact bar that is configured to rotate along with the combination dial and includes a first contact positioned at one end of the contact bar and a second contact positioned at an opposite end of the contact bar, (ii) an inner set of radial contacts that remains stationary with respect to the combination dial and is radially aligned with the first contact of the contact bar, and (iii) an outer set of radial contacts surrounding the inner set of radial contacts that remains stationary with respect to the combination dial and is radially aligned with the second contact of the contact bar, wherein each combination of the inner contact and the outer contact that the first contact and second contact of the contact bar are in contact with, respectively, has a distinct resistance or capacitance value which with the rotational position of the combination dial is determined;

a display screen associated with the sensor and configured to display a position indicia which corresponds to the rotational position of the at least one combination dial; and a mechanism to synchronize the sensor to the dial by resetting the sensor to a given position indicia, which corresponds to the rotational position of the at least one combination dial.

2. The lock assembly of claim 1 wherein the at least one combination dial includes a second position indicia.

3. The lock assembly of claim 2 wherein the position indicia and the second position indicia are synchronized to represent the same rotational position of the at least one combination dial.

4. The lock assembly of claim 3 wherein a user synchronizes the position of the at least one combination dial to the sensor.

5. The lock assembly of claim 1 wherein the at least one combination dial includes an engagement member associated with the sensor to facilitate sensing of the rotational position of the at least one combination dial.

6. The lock assembly of claim 5 wherein the sensor is a bi-directional location sensor and the engagement member is mechanically associated with the sensor.

7. The lock assembly of claim 5 wherein the sensor is a bi-directional location sensor.

8. The lock assembly of claim 5 wherein the engagement member has a single engagement orientation relative to the sensor such that the at least one combination dial is synchronized relative to the sensor.

9. The lock assembly of claim 1 wherein the display screen is part of a digital display assembly which is secured relative to an outer face of the lock body.

10. The lock assembly of claim 9 wherein the digital display assembly is mounted within the lock body and the display screen is aligned with a display opening through the outer face of the lock body.

11. The lock assembly of claim 9 wherein the digital display assembly is secured within a recess defined along the outer face of the lock body.

12. The lock assembly of claim 9 wherein the sensor is battery powered and the battery is supported within the digital display assembly and associated with the sensor.

13. The lock assembly of claim 1 wherein the sensor is battery powered and the battery is supported within the lock body and associated with the sensor.

14. The lock assembly of claim 1 wherein the locking member is mechanically actuated.

15. The lock assembly of claim 1 wherein the locking member is electrically or electromechanically operated.

16. The lock assembly of claim 1 wherein the at least one combination dial is free of position indicia.

17. The lock assembly of claim 1 wherein the at least one combination dial is supported within the lock body with only a portion of the at least one combination dial extending through a slot in the lock body.

18. The lock assembly of claim 17 wherein the lock body includes a notch such that a second position indicia on the at least one combination dial is visible in the notch.

19. The lock assembly of claim 1 wherein the lock assembly is a padlock.

20. The lock assembly of claim 1 wherein the lock assembly is a U-lock.

21. The lock assembly of claim 1 wherein the lock assembly is a cable lock.

22. The lock assembly of claim 1 wherein the display screen is removably mounted to the lock body.

23. The lock assembly of claim 1 wherein the mechanism to synchronize the sensor to the dial is a contact switch that is activated to reset the display to a pre-determined indicia.

* * * * *